US005743324A

United States Patent [19]

Kunstreich et al.

[11] Patent Number: 5,743,324

[45] Date of Patent: Apr. 28, 1998

[54] DISCONNECTABLE ELECTRICAL CONNECTION SYSTEM FOR A MOVING ASSEMBLY

[75] Inventors: Siebo Kunstreich, Saint Ouen; Michel Kouyoumdjian, Chatou, both of France; Minoru Takata, Fukuyama, Japan

[73] Assignee: Rotelec, Bagnolet, France

[21] Appl. No.: 592,347

[22] PCT Filed: Jun. 8, 1995

[86] PCT No.: PCT/FR95/00749

§ 371 Date: Feb. 7, 1996

§ 102(e) Date: Feb. 7, 1996

[87] PCT Pub. No.: WO95/34925

PCT Pub. Date: Dec. 21, 1995

[30] Foreign Application Priority Data

Jun. 10, 1994 [FR] France ..... 94 07133

[51] Int. Cl.[6] ..... B22D 27/02; H01R 13/62

[52] U.S. Cl. ..... 164/504; 164/468; 439/310

[58] Field of Search ..... 164/468, 504; 174/88 S; 439/310, 372, 352, 357, 358

[56] References Cited

U.S. PATENT DOCUMENTS 4,468,858 9/1984 Gulberg et al. .

4,508,404 4/1985 Frawley .

4,834,168 5/1989 Nore et al. ..... 164/468

FOREIGN PATENT DOCUMENTS

2678440A1 12/1992 France .

*Primary Examiner*—Joseph J. Hail, III

*Assistant Examiner*—I.-H. Lin

*Attorney, Agent, or Firm*—Sughrue, Mion, Zinn, Macpeak & Seas, PLLC

[57] ABSTRACT

A downstream connection block (GB) constituted by connector halves (FB1) is electrically connected in permanent manner to a moving assembly (EB). An upstream connection block (GA) is electrically connected in permanent manner to a stationary power supply block (BA) by flexible conductors (CA). A carriage (K) transfers the upstream block (GA) alternately between a front position (PB) providing electrical connection enabling the moving assembly to be powered, and a rear position (PA) remote from the downstream block (GB). The carriage separates from the upstream block when it is to leave said block in said front position. The invention is particularly applicable to electrically powering electromagnetic stirring inductors carried by an oscillating mold in a continuous steel casting installation.

8 Claims, 4 Drawing Sheets

DISCONNECTABLE ELECTRICAL CONNECTION SYSTEM FOR A MOVING ASSEMBLY

CROSS-REFERENCE TO RELATED APPLICATION

This application is a 371 of PCT/FR95/00749 filed Jun. 8, 1995.

BACKGROUND OF THE INVENTION

The present invention relates to making a disconnectable electrical connection between two portions of the same installation. The invention is applicable to the case where one of the portions to be connected, which is typically a stationary portion but which may present a certain degree of mobility and which is referred to below as the "moving assembly" performs, during operation of the installation, limited displacements relative to the other portion which is typically stationary but which may present a certain amount of mobility and which is referred to below as the "stationary assembly" or as the "upstream assembly". Such displacements are typically reciprocating and are referred to below as "functional displacements". Under such circumstances, electrical connection is established before each period of operation and it must be maintained during said period in spite of functional displacements. For example, it may enable the moving assembly to be powered electrically from the stationary assembly.

Disconnectable electrical connection of a moving assembly to a stationary assembly may be implemented by co-operation between two complementary connection blocks, one constituted by male connector halves and the other by female connector halves. In general, two such connector blocks respectively connected in permanent manner to the stationary assembly and to the moving assembly are respectively referred to below as an "upstream block" and as a "downstream block".

A first known connection system is in common use. In that system, the downstream block is stationary while the installation is in operation, and it is connected to electrical terminals of the moving assembly by conductors that are flexible or at least deformable, with deformation thereof allowing functional displacements to take place. This can be summed up by specifying that the downstream block is connected by conductors possessing functional deformation.

At the upstream block, both ends of each conductor which provide permanent connection to the terminals of a stationary assembly are fixed relative to each other in such a manner that the conductors, if not rigid, are at least free from deformation that is imposed by the functional displacements. This can be summed up by saying that the upstream block is connected by conductors without functional deformation.

In certain situations that occur in manufacturing industry, the moving assembly must be capable of being disconnected and taken away between two periods of operation, e.g. to be replaced by an equivalent, new assembly, or to be reinstalled after maintenance operations such as repair or renovation. The amplitude of the displacements necessary for such replacement or maintenance operations is much greater than that of functional displacements.

These displacements are referred to below as being "extrafunctional".

In such a case, it is usual for the downstream block to accompany the moving assembly in its extrafunctional displacements. This avoids any intervention on the electrical network of said assembly. However, if these displacements are performed by taking hold of said assembly and transporting it, the corresponding displacements of the downstream block carried by the flexible conductors present drawbacks when transport operations need to be performed quickly. In addition, after return and installation of a moving assembly that is new or renovated in order to continue operation of the installation, human intervention is required to put the downstream block into position so that it co-operates with the upstream block. That is expensive if the blocks are situated in a zone that is difficult to access, if there is not enough room, and/or if the conditions that obtain in said zone are inhospitable, e.g. if the temperature is high.

Document (U.S. Pat. No. 4,508,404—Frawley) describes a second known connection system. That system is designed for establishing a temporary connection between two spacecraft. One of the craft can be called the "moving assembly" and the other the "upstream assembly". That known system comprises:

- two connection blocks referred to below as the downstream block and the upstream block and electrically connected in permanent manner respectively to the moving assembly and to the upstream assembly, mutual engagement of the two blocks achieving temporary mutual electrical connection between the two assemblies, the conductors which connect the upstream block to the upstream assembly being deformable;
- a carriage performing go-and-return displacements on a transfer path carried by the upstream assembly, said carriage carrying the upstream block both during go displacement to bring it to a front position achieving said connection, and during return displacement to bring said block to a rear position remote from the downstream block; and
- hooking means controlled to hook the upstream block either to the downstream block or to the carriage.

In practice, that second known system is unusable in the above-mentioned situations that are to be found in manufacturing industry.

SUMMARY OF THE INVENTION

A particular object of the present invention is to implement in simple manner a disconnectable connection system that is better adapted to such situations.

According to the present invention, the go-and-return displacements of the carriage and the operation of the hooking members are controlled from the upstream assembly.

In industrial conditions, this invention has the particular advantage that, during the operations of disconnection, transport, and reconnection, no intervention needs to be performed on the electrical network of the moving assembly.

BRIEF DESCRIPTION OF THE DRAWINGS

With reference to the accompanying diagrammatic figures, there follows a more particular description given by way of non-limiting example of how the present invention can be implemented. When the same elements are shown in more than one of the figures, they are designated therein by the same reference symbols.

DESCRIPTION OF THE PREFERRED EMBODIMENT

Figure 1:
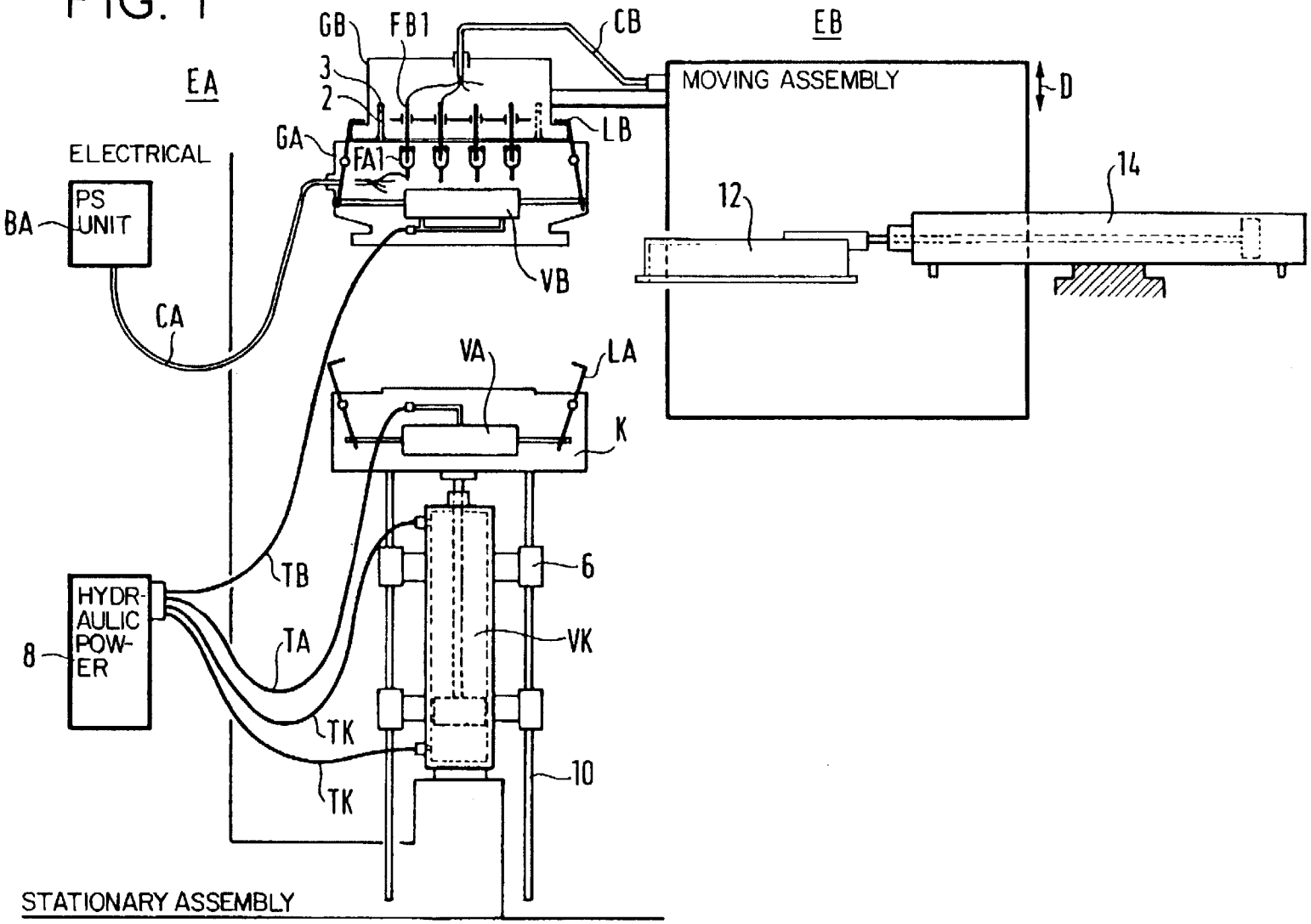
FIG. 1 is a view of a system of the invention, with an electrical connection being established by the system.
Figure 2:
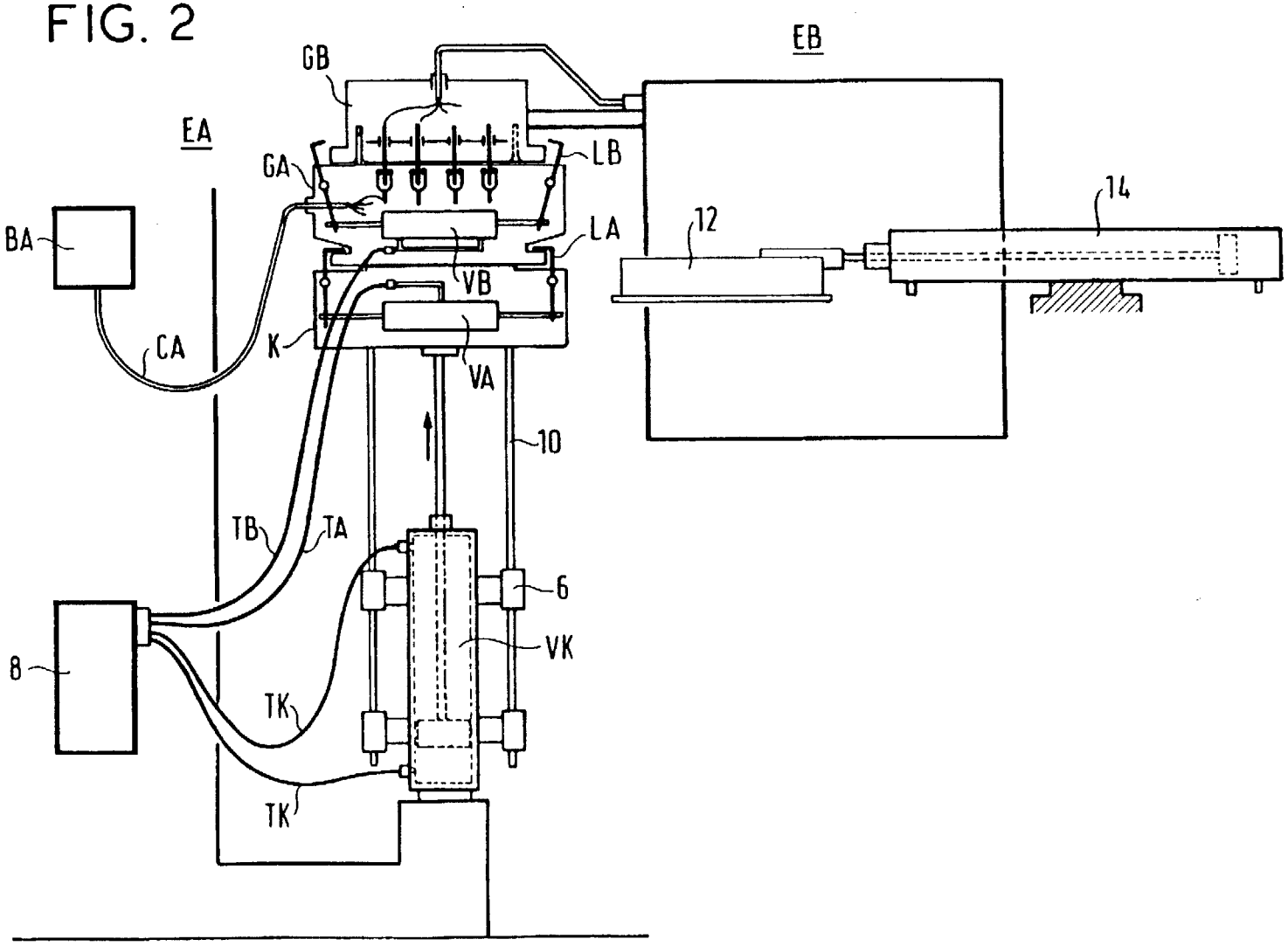
FIG. 2 is a view of the system during a first stage of an operation undertaken to undo the connection.
Figure 3:
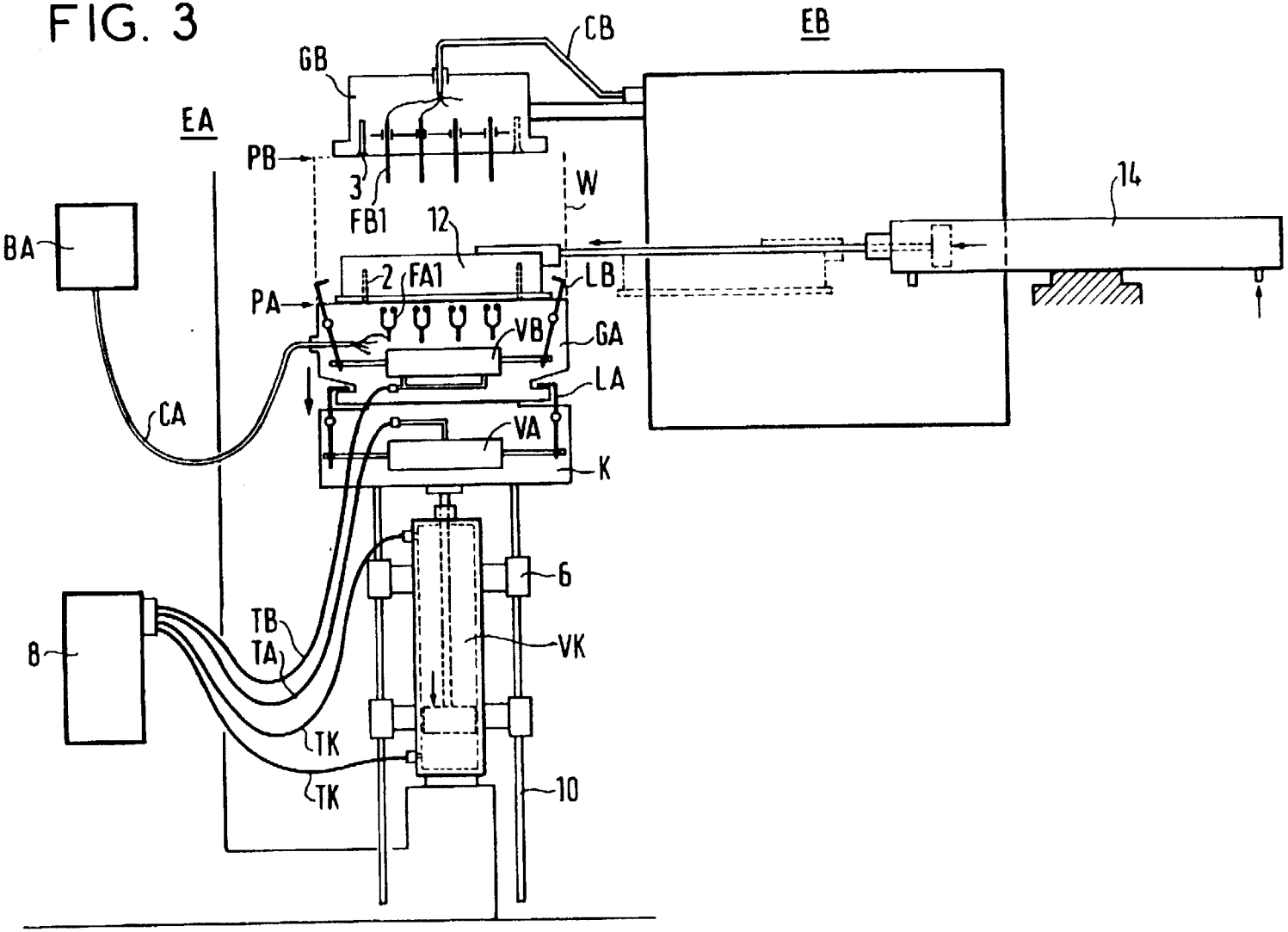
FIG. 3 is a view of the same system when the connection has been undone.
Figure 4:
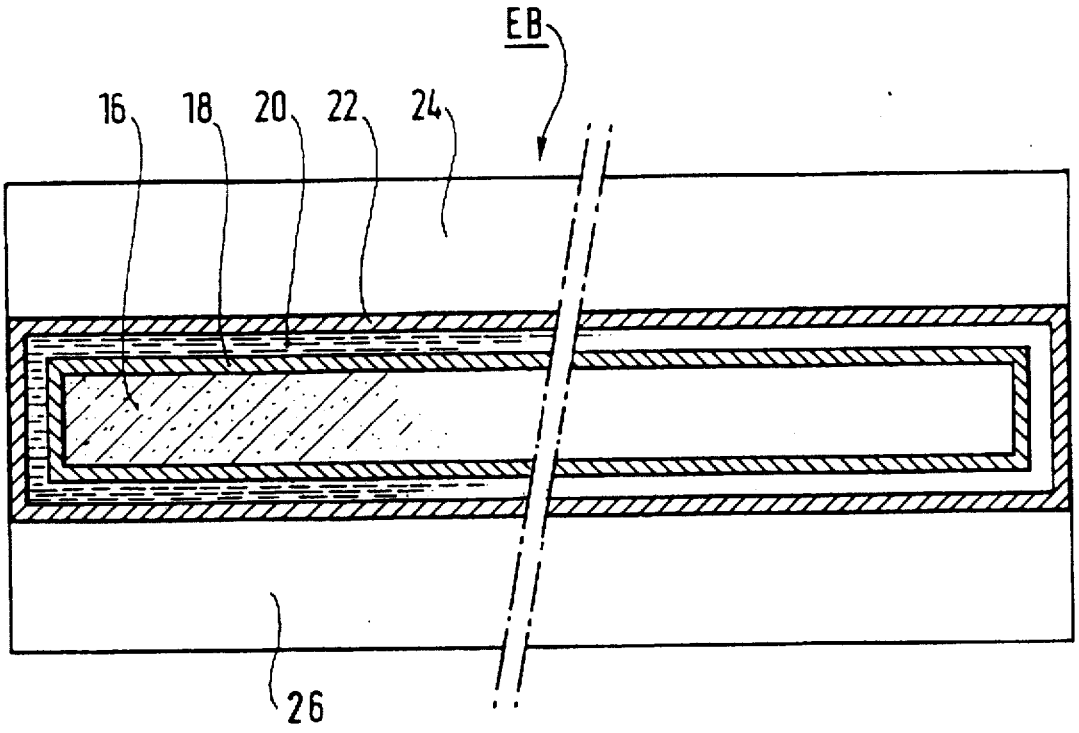
FIG. 4 is a horizontal section view through a mold for continuous casting of steel, said mold being suitable for constituting the moving assembly of the system in the preceding figures.

As shown in FIGS. 1 to 3, a disconnectable electrical connection system for a moving assembly comprises the following known elements:

A connection block GB constituted by connector halves such as FB1 and electrically connected in permanent manner to a moving assembly EB. This connection GB block constitutes a "downstream block".

A connection block GA constituted by connector halves such as FA1 and electrically connected in permanent manner to a stationary assembly EA constituting said upstream assembly. This block GA constitutes an "upstream block". It is complementary to the downstream block in the sense that mutual engagement of the two blocks implements temporary mutual electrical connection between the two assemblies. The conductors such as CA connecting it to the assembly EA are deformable and typically flexible to enable limited functional displacements of said moving assembly when the two blocks are mutually engaged.

A carriage K is suitable for carrying the upstream block GA so as to transfer it on command in alternation between a front position in which said connection is made and a rear position at a distance from the downstream block GB. The carriage is also suitable, on command, for separating itself from the upstream block when placed in said front position. Further, said deformable conductors CA connect said upstream block GA to the stationary assembly EA, whereas in known systems they connect the downstream block to the moving assembly.

The upstream block GA is constituted, for example, by female connector halves such as FA1 connected by flexible conductors to electrical terminals of the stationary assembly EA. The conductors are grouped together in a flexible cable CA. The terminals are those of a power supply unit BA.

The downstream block GB is then constituted by male connector halves such as FB1. These connector halves are connected by a stiff cable CB to electrical members to be powered and belonging to the moving assembly EB. The connector halves of at least one of the two blocks are provided with floating mounts, and mutually complementary insertion guides such as 2 and 3 (see FIG. 3) are disposed in conventional manner to compensate for possible positioning inadequacies. Separation of the two connection blocks makes it possible for the moving assembly to perform extrafunctional displacements that are greater than the functional displacements allowed by the flexible cables.

More specifically, the carriage K performs go-and-return displacements along a stationary transfer path W (see FIG. 3). For example, this path is defined by guide rods 10 fixed to the carriage and guided by hollow guides 6.

The carriage K carries the upstream block GA alternately during go displacement PA-PB to bring it to its front position PB, and during return displacement PB-PA to bring it to its rear position PA remote from the downstream block GB (see FIG. 3).

The system also includes rear and front hooking members LA and LB so that after the upstream block GA has been placed in its front position PB during go displacement of the carriage K for the purpose of making said connection, it remains secured during the following return displacement of the carriage either to the downstream block GB so as to maintain said electrical connection, or else to said carriage so as to undo said connection, thereby achieving disconnection.

The functional displacements D give rise to alternating displacements of the upstream block GA along a linear stroke W which is typically 1 mm to 15 mm long.

The transfer path W then preferably follows this linear stroke. This disposition presents the following advantage: when the functional displacements have been stopped and have left the upstream block in a non-predetermined stop position, it then suffices for the go displacement of the carriage K to be sufficiently extended to enable the carriage to reach the block regardless of the position in which it has stopped.

Functional displacements are typically constituted by reciprocating rectilinear translation.

The go-and-return displacements PA-PB and PB-PA of the carriage, and the operation of the hooking members LA and LB are driven by actuators, e.g. fluid actuators VK, VA, and VB. All of these actuators are controlled from a common stationary control station 8 via control connection means that may convey electricity or matter, and which are constituted, for example, by flexible feed pipes TK, TA, and TB that convey a working fluid.

The front hooking members LB are driven by an actuator VB to hook the upstream block GA to the downstream block GB and to unhook it therefrom. They are preferably carried by the upstream block. The rear hooking members LA are driven by an actuator VA to hook the upstream block to the carriage and to unhook it therefrom. They are preferably carried by the carriage K.

The functional displacement D and the transfer path W guiding the carriage K are vertical, for example, the front position PB of the upstream block GA being above its rear position PA. In this case, the stationary assembly EA preferably also carries a moving protective cover 12 and an actuator 14 to bring the cover over the upstream block GA and thereby protect it when it is in its rear position PA. Naturally, this actuator takes the cover away from the stroke of the block and of the carriage K during displacements of the carriage. The protective cover may also be placed manually on the upstream block GA.

The connector halves such as FA1 and FB1 are typically adapted to convey electrical currents of more than 400 A, e.g. 1000 A.

The system of the invention is advantageously applicable in an installation for vertical continuous casting of a metal such as steel when the moving assembly EB is an oscillating ingot mold. Said functional displacements D are then constituted by vertical oscillation which is imparted to said mold in order to prevent adhesion between the metal 16 and the cooled wall 18 of the mold. This cooled wall solidifies the surface of a flow of liquid metal passing through the mold under the effect of gravity. It is cooled by a flow of water 20 between itself and an outer wall 22. The greater, extrafunctional displacements of the moving assembly are associated with removing a worn mold and in installing a replacement mold. The mold includes inductors such as 24 and 26 that constitute said electrical members to be powered and that perform electromagnetic stirring inside the flow of metal 16 as it passes through the mold. The stationary assembly EA is a stationary frame for said installation.

Electrical terminals of said stationary assembly are those of an electrical power supply unit BA powering the inductors via said two connection blocks GA and GB.

The advantages of the present invention can then be seen because it is important for the mold to be replaced quickly and replacement must neither be slowed down nor made more complicated by the electrical disconnection and reconnection operations that necessary accompany such replacement. In addition, no intervention needs to be performed on the electrical network of the mold.

Nevertheless, the moving assembly could also be constituted, for example, by a vibrating portion of a vibrating conveyor if said vibrating portion needed to carry electrical power members such as a motor driving an eccentric mass in order to generate the vibrations.

In such industrial applications, the present invention makes it easy to perform remote control and to perform electrical connection and disconnection operations quickly on circuits suitable for conveying high currents, without requiring any manual intervention on electrical members.

We claim:

1. A disconnectable electrical connection system for a moving assembly, the system comprising:

a downstream block (GB) electrically connected in permanent manner to a moving assembly (EB) performing limited functional displacements relative to an upstream assembly (EA);

an upstream block (GA) complementary to the downstream block for making a temporary mutual electrical connection between said two blocks;

deformable conductors (CA) electrically connecting the upstream block (GA) to the upstream assembly (EA) in permanent manner while enabling said upstream block to follow said functional displacements in order to maintain said connection;

a carriage (K) performing go-and-return displacements on a transfer path carried by the upstream assembly EA, said carriage being suitable for carrying the upstream block (GA) both during a go displacement (PA-PB) to move the upstream block to a front position (PB) making said connection, and during a return displacement (PB-PA) for bringing said upstream block to a rear position (PA) remote from the downstream block; and hooking members (LA, LB) controlled to hook the upstream block (GA) to at least one of the downstream block (GB) and the carriage;

wherein the go-and-return displacements (PA-PB, PB-PA) of the carriage (K) and the operation of the hooking members (LA and LB) are controlled from the upstream assembly.

2. A system according to claim 1, said system being applied to the case where said functional displacements (D) of the moving assembly give rise to alternating displacements of the downstream block (GB) on a linear stroke (W), said system being characterized by the fact that said transfer path (W) follows said linear stroke in such a manner that, when the functional displacements have been stropped and have left the downstream block in a stop position that is not predetermined, go displacement of the carriage (K) bearing the upstream block (GA), enables it to reach said downstream block (GB) regardless of the stop position thereof.

3. A system according to claim 1, wherein said hooking members comprise:

front hooking members (LB) driven by an actuator (VB) to hook the upstream block (GA) to the downstream block (GB) and to unhook it therefrom; and rear hooking members (LA) driven by an actuator (VA) to hook the upstream block to the carriage (K) and to unhook it therefrom.

4. A system according to claim 3, wherein the front and rear hooking members (LB, LA) are carried respectively by the upstream block (GA) and by the carriage (K).

5. A system according to claim 3, wherein the actuators of the hooking members and an actuator driving displacements of the carriage are constituted by fluid actuators (VK, VA, VB) that use a working fluid and that are connected to a control station (8) by feed pipes (TK, TA, TB) conveying said fluid, said control station being carried by the upstream assembly (EA), with at least the feed pipes (TA, TB) for the hooking member actuators (LA, LB) being deformable.

6. A system according to claim 1, the functional displacement (D) and the transfer path (W) guiding the carriage (K) are vertical, the upstream assembly (EA) being stationary, the front position (PB) of the upstream block (GA) being above its rear position (PA), the stationary assembly (EA) further carrying a moving protective cover (12) and an actuator (14) for bringing said cover over the upstream block (GA) when said block is in its rear position (PA) and for removing said cover from the path of said block and of the carriage (K) during displacements of the carriage.

7. A system according to claim 1, wherein the upstream and downstream blocks (GA, GB) are adapted to convey electrical currents greater than 400 A.

8. A system according to claim 7, said system being used in an installation for vertical continuous casting of a metal such as steel, the moving assembly (EB) being an oscillating mold, the mold including inductors (24, 26) for providing electromagnetic stirring of metal (16) passing through said mold, the upstream assembly (EA) being stationary and including a frame of the installation provided with an electrical power supply unit (BA) powering said inductors via said upstream and downstream blocks (GA and GB).

* * * * *